US006101346A

United States Patent [19]

Arakawa

[11] Patent Number: 6,101,346

[45] Date of Patent: Aug. 8, 2000

[54] IMAGE FORMING APPARATUS CAPABLE OF HIGH SPEED WARM-UP WITH LOW POWER CONSUMPTION

[75] Inventor: Hiroyuki Arakawa, Abiko, Japan

[73] Assignee: Canon Kabushiki Kaisha, Tokyo, Japan

[21] Appl. No.: 09/188,686

[22] Filed: Nov. 10, 1998

[30] Foreign Application Priority Data

Nov. 14, 1997 [JP] Japan ..... 9-331108

[51] Int. Cl.[7] ..... G03G 15/20

[52] U.S. Cl. ..... 399/70; 219/216; 399/69; 399/330

[58] Field of Search ..... 399/67, 69, 90, 399/328, 330, 70; 219/216, 469–471

[56] References Cited

U.S. PATENT DOCUMENTS

| | | | |
|---|---|---|---|
| 4,642,448 | 2/1987 | Shigemura et al. | 219/216 |
| 5,109,255 | 4/1992 | Nishikawa et al. | 399/70 |
| 5,206,694 | 4/1993 | Ohira et al. | 219/216 X |
| 5,321,478 | 6/1994 | Nakamura et al. | 219/216 X |
| 5,489,935 | 2/1996 | Dornier | 219/216 X |
| 5,700,994 | 12/1997 | Gheer et al. | 399/328 X |

*Primary Examiner*—Susan S. Y. Lee

*Attorney, Agent, or Firm*—Fitzpatrick, Cella, Harper & Scinto

[57] ABSTRACT

An image forming apparatus has an image forming unit for forming an unfixed image on a recording material, an image fixing device for fixing the unfixed image on the recording material, the image fixing device having at least one heater, and a power supply for supplying electric power to the heater. The power supply supplies electric power to the heater until the fixing device reaches a predetermined temperature possible to start copy after a power source of the image forming apparatus is turned ON, and preparation of the image forming unit permitting image formation on the recording material is effected before the fixing device reaches the temperature possible to start fixing after the power source is turned ON, and, during the preparation, the power supply reduces the electric power supplied to the heater, and, after the preparation, the power supply increases the electric power supplied to the heater.

5 Claims, 6 Drawing Sheets

IMAGE FORMING APPARATUS CAPABLE OF HIGH SPEED WARM-UP WITH LOW POWER CONSUMPTION

BACKGROUND OF THE INVENTION

1. Field of the Invention

The present invention relates to an image forming apparatus such as a copying machine, a printer and the like.

2. Related Background Art

In general, a copying machine has a function for reading an image on an original and the like and serves to form an image on a sheet on the basis or read image information. In recent years, there has been proposed a copying machine having a communication function for inputting image information sent from an external equipment.

Further, in general, a printer serves to form an image on a sheet on the basis of image information sent from an external equipment such as a computer, and a facsimile has generally a function for reading an image on an original and a communication function so that read image information sent to an external equipment and forms an image on a sheet on the basis of information sent from an external equipment.

In such image forming apparatuses, there is provided an image bearing member (photosensitive drum or the like), and a toner image formed on the image bearing member is electrostatically transferred onto a transfer material (such as a paper sheet) by means of a transfer charger, and, thereafter, an unfixed toner image on the transfer material is thermally fixed as a permanent image by means of a fixing device.

In the past, there have been proposed various fixing devices.

In general, fixing devices in which the toner image is thermally fused to be fixed to the transfer material, and, fixing devices in which the transfer material is passed through a nip between a pair of rollers at least one of which includes a heat source and the toner image is fixed to the transfer material by heat and pressure have widely been used.

In such fixing devices, in order to maintain good fixing ability, a maximum electric power available within a predetermined electric power range is applied to a fixing heater so that reduction of a surface temperature of the fixing roller is prevented and a time period possible to start copy (warm-up time period) for rising-up the device for preparation for a copying operation, for example, in the first use is reduced.

However, in the above-mentioned conventional case, there arose the following problems.

In an image forming apparatus in which potential control for effecting preparation of an image forming portion (for example, for stabilizing potential of a photosensitive member by driving a charger and a lamp) is performed during the warm-up of the fixing device, if the electric power used for the potential control is added, the total electric power will exceed the predetermined electric power range.

In order to suppress the total electric power below the predetermined electric power, during the warm-up of the fixing device, at the same time when the charger and the lamp are driven, the output of the fixing heater is reduced, and the temperature is increased up to a predetermined temperature possible to start copy while reducing the output of the heater even after the preparation of the image forming portion is finished and the charger and the lamp are turned OFF.

Accordingly, in dependence upon the reduction of the output of the fixing heater, the time period required for increasing the temperature up to the predetermined temperature possible to start copy is lengthened.

Particularly, in case of a high speed apparatus requiring a greater amount of heat, since the temperature possible to start copy is high and heat capacities of the fixing roller and the pressure roller are also great, a long time period is consumed for the preparing operation.

SUMMARY OF THE INVENTION

The present invention aims to eliminate the above-mentioned conventional drawbacks, and an object of the present invention is to provide an image forming apparatus in which a time period possible to start print after turning ON of a power source is short.

Another object of the present invention is to provide an image forming apparatus which comprises an image forming means for forming an unfixed image on a recording material, an image fixing means for fixing the unfixed image on the recording material, and a power supply means for supplying an electric power to a heater, and preparation of the image forming means starting image formation on the recording material is effected until the fixing means reaches a temperature possible to fix after a power source is turned ON, and, during time period of the preparation, the power supply means reduces the electric power supplied to the heater, and, after the preparation, the power supply means increases the electric power supplied to the heater.

The other objects and features of the present invention will be apparent from the following detailed explanation of the invention.

DESCRIPTION OF THE PREFERRED EMBODIMENTS (First embodiment)

An image forming apparatus according to a first embodiment of the present invention will be explained with reference to FIGS. 1 to 4.

First of all, the entire construction of a copying machine as an example of the image forming apparatus will be described briefly with reference to FIG. 2.

Figure 2:
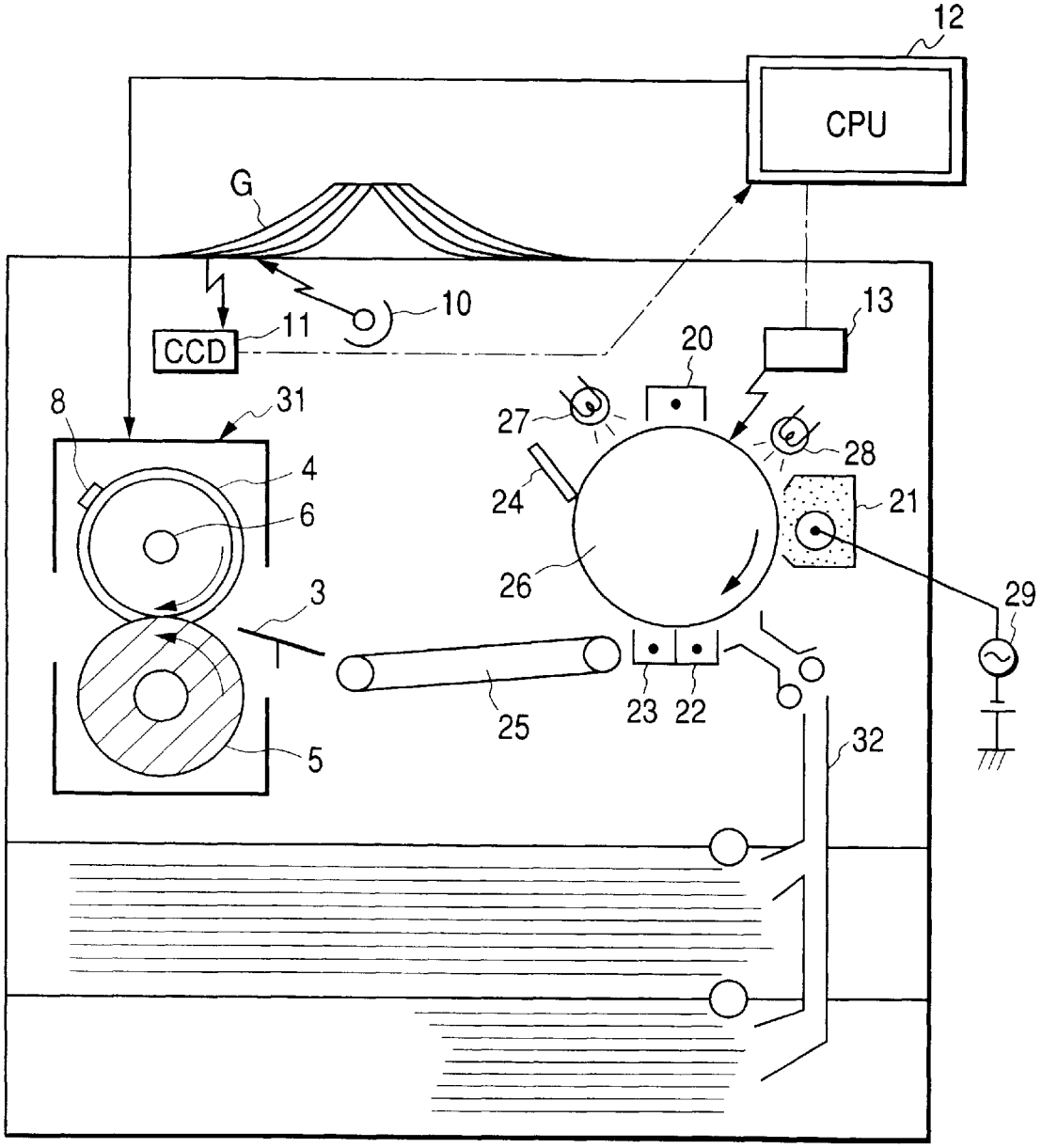
FIG. 2 is a schematic sectional view of the image forming apparatus.

FIG. 2 is a schematic sectional view of the image forming apparatus.

As shown in FIG. 2, the image forming apparatus includes an image bearing member (photosensitive member) 26 rotated in a direction shown by the arrow, and a primary charger 20 opposed to the image bearing member 26 and adapted to uniformly charge a surface of the image bearing member 26.

Light from a light source 10 is illuminated onto an original G, and light reflected from the original G is focused on a reading element (CCD) 11. The focused light is converted into an image-modulated digital image signal through a control device (CPU) 12 and is radiated onto the charged surface of the image bearing member 26 as laser 13, thereby forming an electrostatic latent image on the image bearing member 26.

The electrostatic latent image is developed by a developing device 21 as a toner image. The toner image is electrostatically transferred onto a sheet by means of a transfer charging device 22. Then, the sheet is separated from the image bearing member 26 by means of a separation charging device 23, and the separated sheet is conveyed to a fixing device 31 through a convey path 25.

The sheet passed through the convey path 25 is conveyed to a nip between a fixing roller 4 including a heater (halogen heater) as a heating source therein and a pressure roller 5 urged against the fixing roller through a guide 3. While the sheet is being passed through the nip, an unfixed toner image is heated and pressurized to fuse (melt) and fix the toner, thereby providing a hard copy, which is in turn discharged out of the apparatus.

Incidentally, a surface of the fixing roller 4 is preferably formed from fluororesin such as PTFE to prevent offset, and the pressure roller 5 is preferably formed from elastic material such as rubber to provide a required nip width.

Further, a temperature sensing element 8 such as a thermistor or a thermocouple is contacted with an outer surface of the fixing roller 4, and a detection signal from the temperature sensing element is transferred to a conventional control means so that the temperature of the outer surface of the fixing roller 4 is maintained to a predetermined toner image fusing temperature by controlling output of the heater 6 or voltage applied to the heater 6 by means of the control means.

Figure 3:
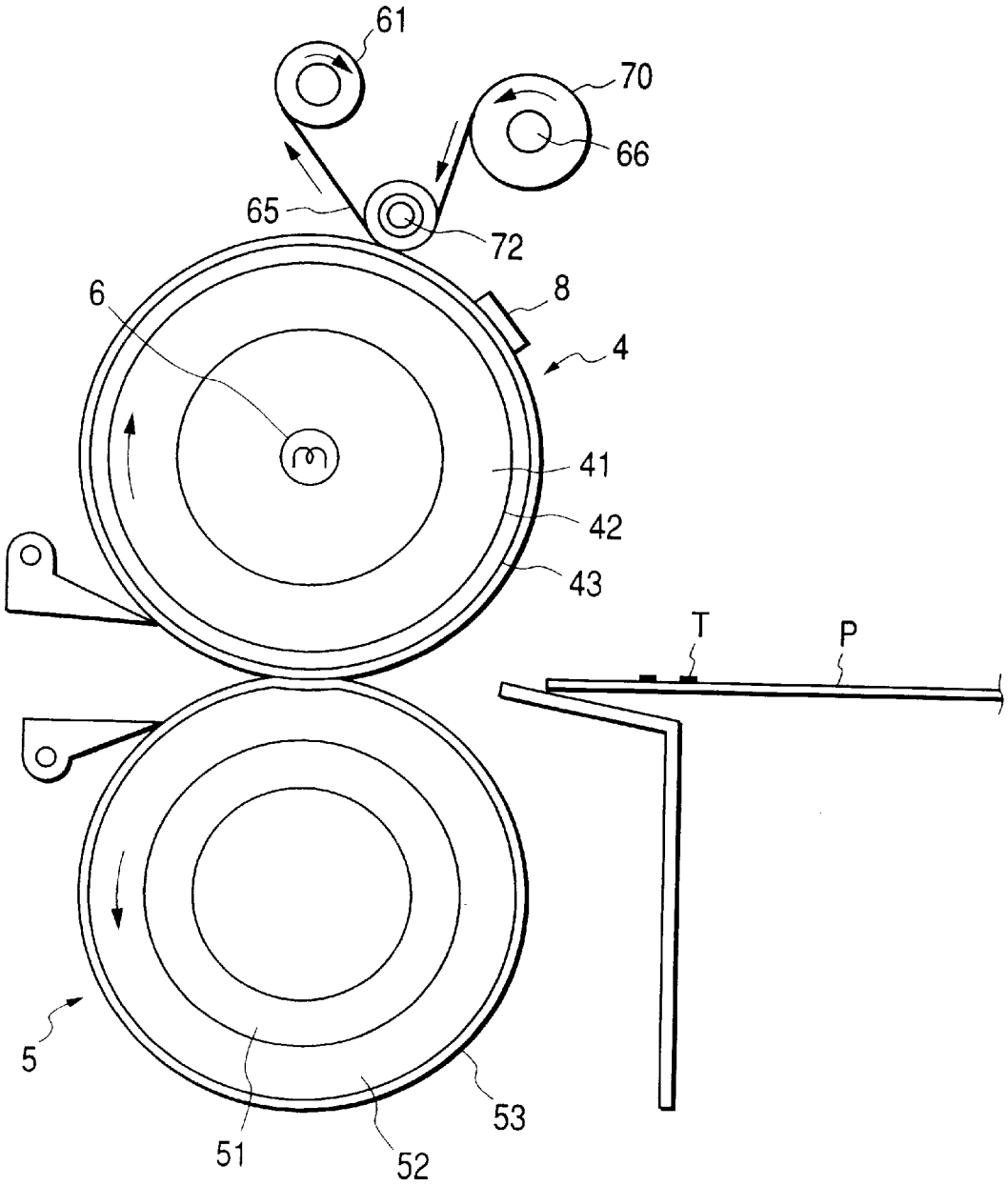
FIG. 3 is a schematic constructural view of a fixing device used in the image forming apparatus according to the first embodiment of the present invention.

Next, the fixing device 31 will be explained further fully, particularly with reference to FIG. 3. FIG. 3 is a schematic constructural view of the fixing device used in the image forming apparatus according to the first embodiment of the present invention.

First of all, it is preferable that the fixing roller 4 is constituted by a hollow roller core 41 made of metal such as aluminium, stainless steel or iron, a heat-resistive elastic layer 42 coated on the roller core and having a thickness of about 0.1 to 1.0 mm, and a mold releasing layer (resin layer) 43 coated on the elastic layer and having a thickness of about 1.0 to 40 $\mu$m.

It is preferable that the pressure roller 5 is constituted by a metallic roller core 51, an elastic layer 52 made of silicone rubber, fluoro-rubber or fluoro-silicone rubber and coated on the roller core and having a relatively great thickness (for example, about 5 to 10 mm), and a mold releasing layer (fluororesin layer) 53 coated on the elastic layer and having a thickness of about 30 to 50 $\mu$m.

A cleaning device for removing offset toner and/or foreign matters adhered to the surface of the fixing roller 4 is disposed on the fixing roller 4, and the cleaning device utilizes a cleaning web 70 formed from heat-resistive non-woven fabric made of Nomex or Himelon.

The web 70 is normally manufactured by providing non-woven fabric having moderate softness and strength by mixing hot and soft polyester fibers with aromatic polyamide fibers and by impregnating silicone oil having viscosity of about 10,000 cSt (=1 $m^2/s$) to the non-woven fabric.

A web urging roller 65 is constituted by a metallic core, and a heat-resistive rubber (for example, silicone rubber) layer coated on the core. In order to adequate softness, foaming agent is added into the rubber to obtain sponge feature.

Incidentally, hardness of the rubber is 10 to 20° (Asker C).

Both ends of the web urging roller 65 are rotatably supported by bearings. By urging the web against the fixing roller 4 by means of the web urging roller, the offset toner and foreign matters (paper powder and the like) adhered to the surface of the fixing roller 4 are removed, thereby preventing offset.

A web take-up shaft 61 is rotated in the direction shown by the arrow by means of a drive means (not shown), and the web 70 is supplied from a web supply shaft 66 by a predetermined amount in synchronous with the copying operation.

A halogen heater of 1200 W can be used as the heater (heating source) 6.

The control device 12 serves to control the timing of the entire operation of the image forming apparatus and collectively controls a series image forming operations such as formation of the toner image on the image bearing member 26, the transferring the toner image onto the transfer material at a transfer/separation portion 22, 23 and the fixing of the toner image to the transfer material at the fixing device 31.

Next, the rising-up of the apparatus (for example, preparing operation for preparing for first use after the power source is turned ON) will be explained with reference to FIG. 1.

The preparing operation includes a preparing operation for heating the heater 6 to bring the fixing roller 4 to a predetermined temperature possible to start fixing, and a preparing operation for stabilizing the surface potential of the image bearing member 26. Such operations are effected as follows.

Figure 1:
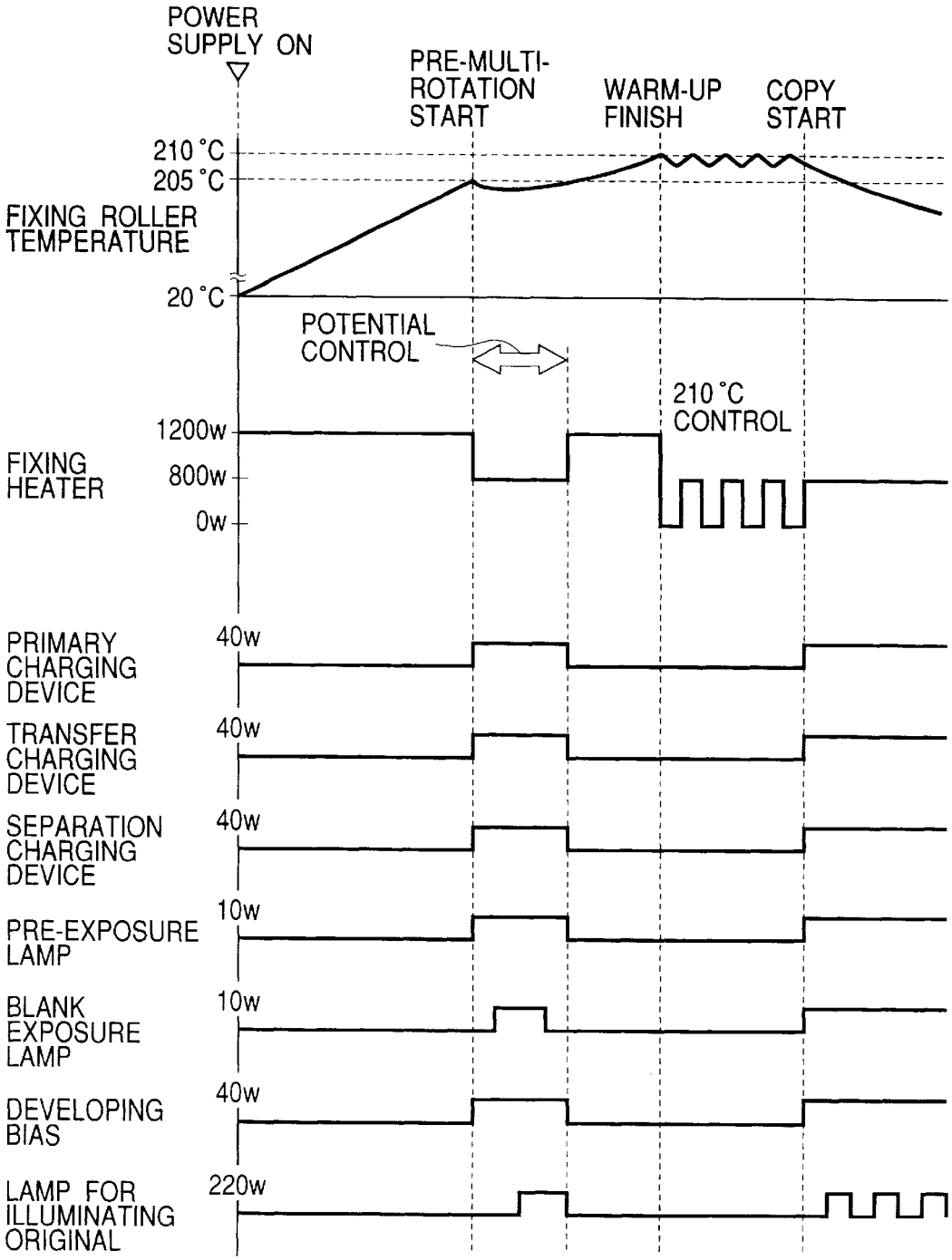
FIG. 1 is a timing chart showing a preparing operation of an image forming apparatus according to a first embodiment of the present invention.

FIG. 1 is a timing chart showing a preparing operation of the image forming apparatus according to the first embodiment of the present invention.

First of all, when the power source is turned ON, the heater 6 is energized in a condition that the fixing roller 4 and the pressure roller 5 are stopped, with the result that the temperature of the fixing roller 4 starts to be increased.

When the detection temperature of the thermistor 8 reaches 205° C., a drive motor (not shown) is driven to start rotations of the fixing roller 4 and the pressure roller 5.

At the same time, in order to optimize the surface potential of the image bearing member 26, the primary charger 20 (40 W), transfer charging device 22 (40 W), separation charging device 23 (40 W), pre-exposure lamp 27 (10 W) and developing bias 29 (40 W) are operated. Incidentally, during the preparing operation, a blank exposure lamp 28 (10 W) and a lamp 10 (220 W) for illuminating original are also operated.

In this case, since the electric power (400 W at the maximum) is consumed due to the operations of the chargers and the lamps, the output of the heater is decreased from 1200 W to 800 W during the potential control.

That is to say, the electric power supplied to the heater is reduced by an amount of electric power required for the potential control.

After the potential control, the output of the heater is returned to 1200 W again. When the detection temperature of the thermistor 8 reaches 210° C., copy start is permitted (preparing operation is finished).

Namely, after the potential control during pre-multi-rotation when the apparatus is risen-up, by increasing the output of the heater, the warm-up time period can be decreased within a predetermined electric power range.

Now, on the basis of test results regarding the embodiment, the effect that the warm-up time period is decreased will be explained with reference to FIG. 4.

Figure 4:
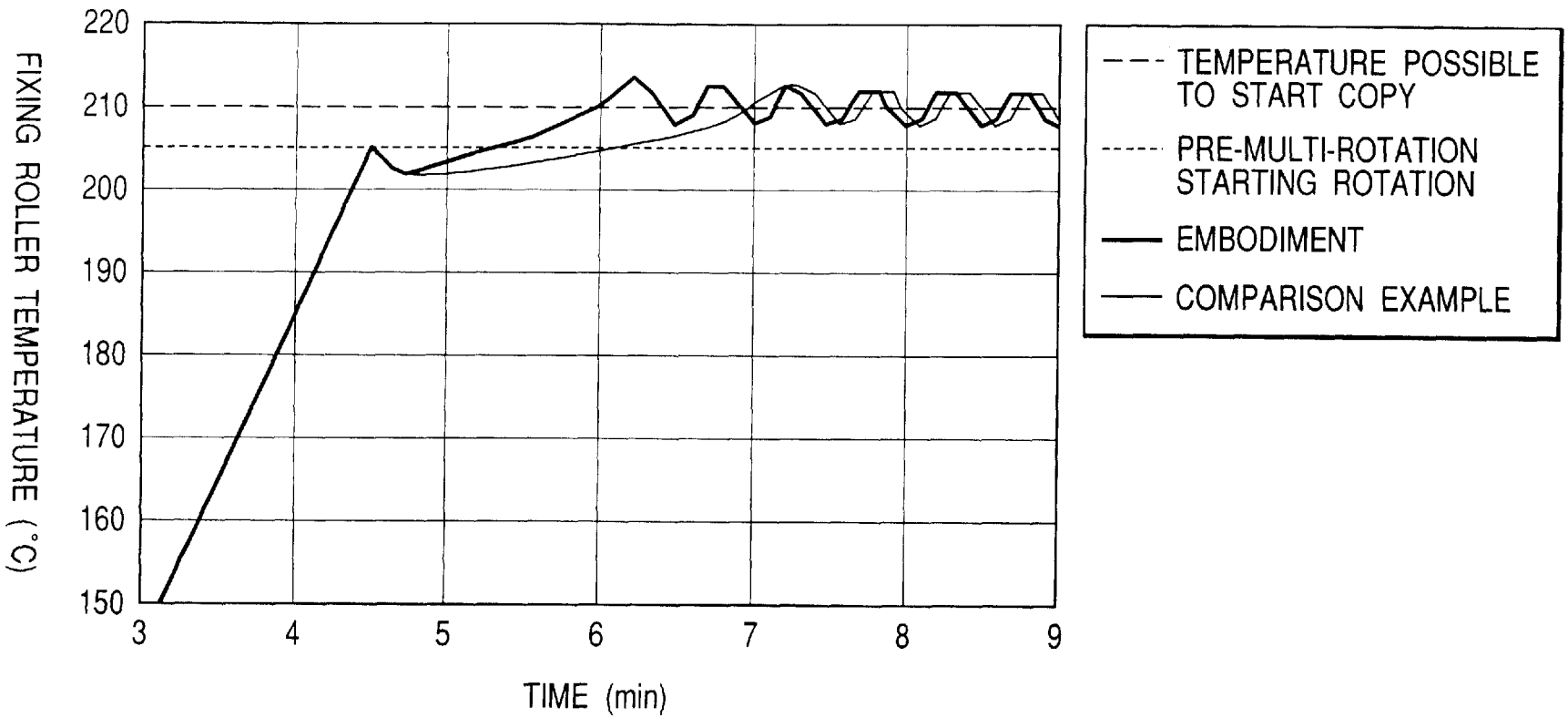
FIG. 4 is a graph showing comparison in changes in a surface temperature of a fixing roller in the preparing operation.

FIG. 4 is a graph showing comparison in changes in a surface temperature of a fixing roller in the preparing operation.

In the illustrated embodiment, the above-mentioned control was effected.

In a comparison example, at the time when the surface temperature of the fixing roller 4 of 205° C. is detected, when the pre-multi-rotation is started, the output of the heater is decreased from 1200 W to 800 W, and, at the same time, the potential control of the image bearing member is effected.

And, even after the potential control, the temperature of the fixing roller 4 is increased up to 210° C. in the condition that the output of the heater is maintained to the lowered value of 800° C.

In FIG. 4, under the environment having a temperature of 20° C., the surface temperatures of the fixing rollers 4 in the embodiment and the comparison example at the rise-up were measured.

In the comparison example, the warm-up time period for obtaining the temperature possible to start copy (210° C.) was seven minutes; whereas, in the embodiment, the warm-up time period could be reduced to six minutes.

(Second embodiment)

Figure 5:
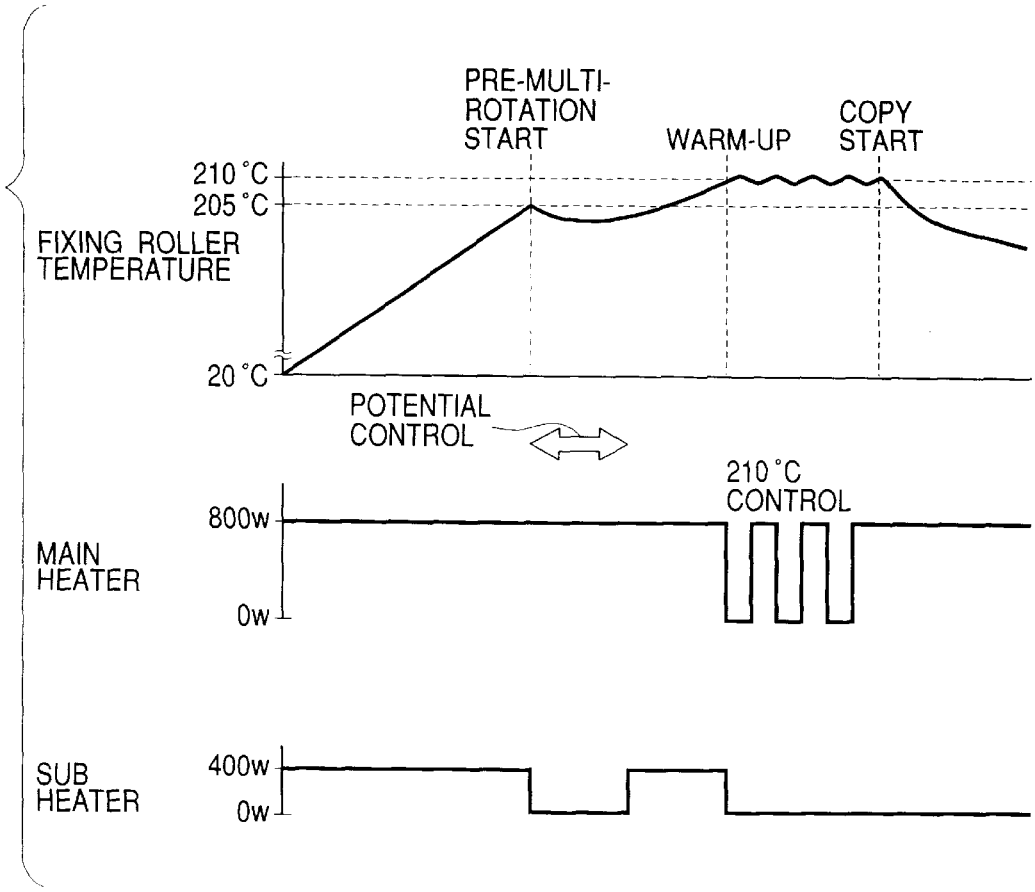
FIG. 5 is a timing chart showing a preparing operation of an image forming apparatus according to a second embodiment of the present invention.
Figure 6:
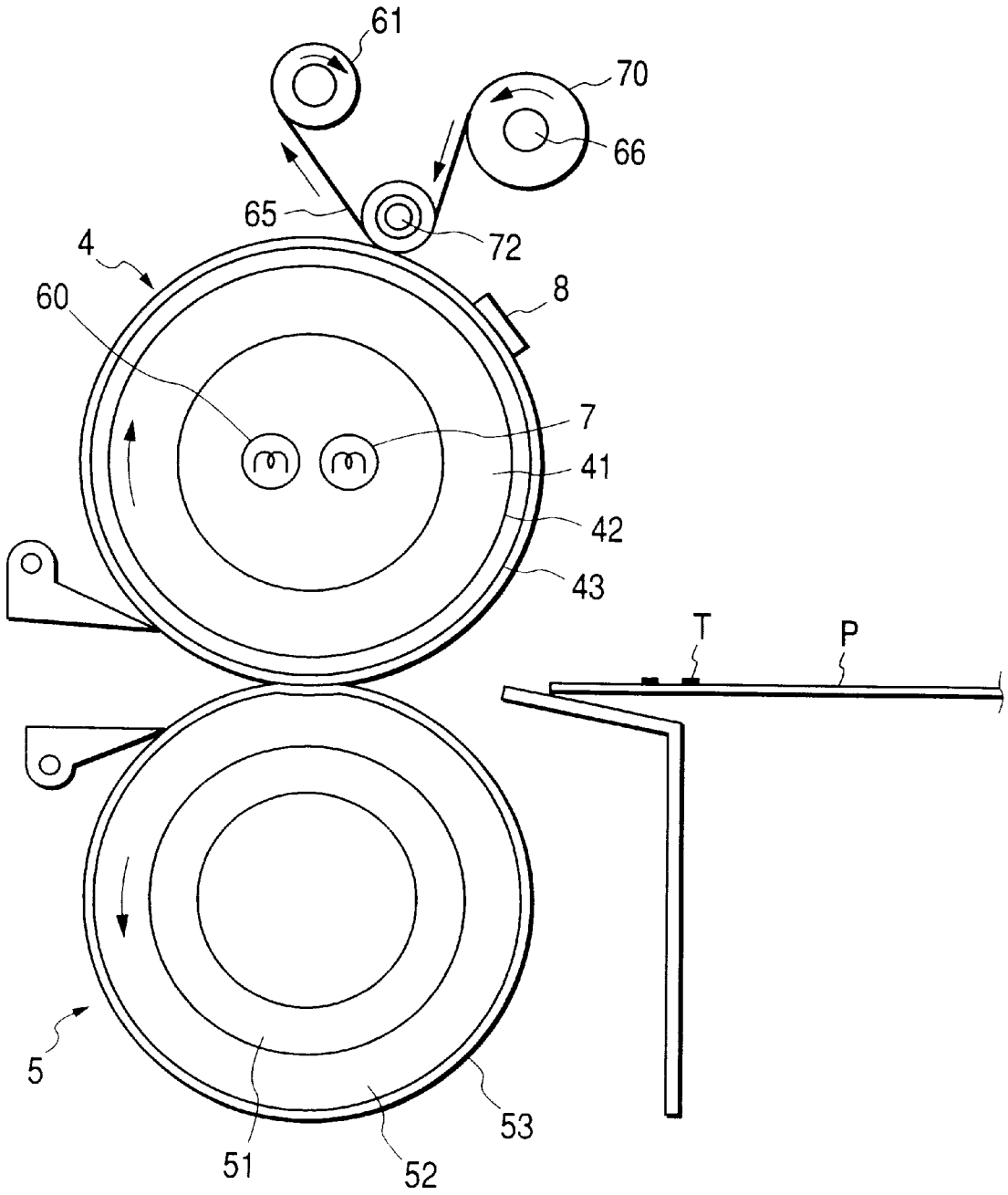
FIG. 6 is a schematic constructural view of a fixing device used in the image forming apparatus according to the second embodiment of the present invention.

FIGS. 5 and 6 shows a second embodiment of the present invention. In the above-mentioned first embodiment, while an example that the consumed electric power of the entire copying machine is suppressed to the predetermined value by changing the electric power supplied to the single heater was explained, in the second embodiment, a plurality of heaters are provided and the amount of electric power is changed only by ON/OFF control of a predetermined or selected heater.

Since the other construction and function are the same as those in the first embodiment, the same element are designated by the same reference numerals and explanation thereof will be omitted.

FIG. 5 is a timing chart showing a preparing operation of an image forming apparatus according to the second embodiment of the present invention, and FIG. 6 is a schematic constructural view of a fixing device used in the image forming apparatus according to the second embodiment of the present invention.

In the second embodiment, as shown in FIG. 6, two heating source heaters (main heater and sub heater) are provided within the fixing roller, and a halogen heater of 800 W is used as the main heater 60 and a halogen heater of 400 W is used as the sub heater 7.

In the preparing operation, as shown in FIG. 5, during the potential control effected in the pre-multi-rotation, only the sub heater is turned OFF, and, after the potential control, the sub heater is turned ON again.

First of all, when the power source is turned ON, the main heater 60 and the sub heater 7 are energized to start the increase in temperature of the fixing roller 4.

At the time when the detection temperature of the thermistor 8 reaches 205° C., the pre-multi-rotation of the fixing roller 4 and the pressure roller 5 is started, and, at the same time, the sub heater 7 is disenergized, and, in order to optimize the surface potential of the image bearing member 26, the potential control is effected.

After the potential control, the sub heater is energized again. At the time when the detection temperature of the thermistor 8 reaches 210° C., copy start is permitted (preparing operation is finished).

Namely, after the potential control during pre-multi-rotation when the apparatus is risen-up, by energizing the sub heater 7 again, the warm-up time period can be decreased within a predetermined electric power range.

Now, test results in a comparison example and the embodiment will be explained.

In the comparison example, at the time when the surface temperature of the fixing roller 4 of 205° C. is detected, when the pre-multi-rotation is started, the sub heater is disenergized, and, at the same time, the potential control of the image bearing member 26 is effected. And, even after the potential control, the temperature of the fixing roller 4 is increased up to 210° C. only by the main heater 60.

Under the environment having a temperature of 20° C., in the comparison example, the warm-up time period for obtaining the temperature possible to start copy was seven minutes; whereas, in the embodiment (when the above control was effected), the warm-up time period could be reduced to six minutes.

That is to say, also in the second embodiment, the warm-up time period can be decreased within a predetermined electric power range.

The present invention is not limited to the above-mentioned embodiments, but, various alteration can be made within the scope of the invention.

What is claimed is:

1. An image forming apparatus, comprising:

image forming means for forming an unfixed image on a recording material;

image fixing means for fixing the unfixed image on the recording material, said image fixing means having at least one heater; and power supply means for supplying an electric power to said heater, wherein said power supply means supplies the electric power to said heater until said fixing means reaches a predetermined temperature for fixing the unfixed image after a power source of main body of the image forming apparatus is turned ON;

wherein said image forming means begins a time period of preparation of image formation on the recording material until said fixing means reaches the predetermined temperature after the power source is turned ON, and during the time period of preparation, said power supply means reduces the electric power supplied to said heater, and, after the preparation, said power supply means increases the electric power supplied to said heater until said fixing means reaches the predetermined temperature.

2. An image forming apparatus according to claim 1, wherein a supply electric power of said power supply means before the time period of the preparation is the same as a supply electric power of said power supply means after the time period of the preparation.

3. An image forming apparatus according to claim 1, wherein said fixing means has a plurality of said heaters, and, during the time period of the preparation, said power supply means turns OFF supply of the electric power to at least one of said heaters.

4. An image forming apparatus according to claim 1, wherein the time period of preparation is started when said fixing means reaches a predetermined temperature lower than the temperature possible to fix.

5. An image forming apparatus according to claim 4, wherein said fixing means has a fixing roller, and a pressure roller contacted with said fixing roller, and said fixing roller and said pressure roller start to rotate when said fixing roller reaches the predetermined temperature.

* * * * *

UNITED STATES PATENT AND TRADEMARK OFFICE

CERTIFICATE OF CORRECTION

PATENT NO. : 6,101,346

DATED : August 8, 2000

INVENTOR(S): HIROYUKI ARAKAWA

It is certified that error appears in the above-identified patent and that said Letters Patent is hereby corrected as shown below:

COLUMN 4:
Line 14, "synchronous" should read --synchronism--;
Line 20, "series" should read --series of--; and
Line 22, "transferring" should read --transferring of--.

COLUMN 5:
Line 26, "shows" should read --show--; and
Line 36, "element" should read --elements--.

COLUMN 6:
Line 13, "copy" should read --copying--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*